US006652394B1

(12) United States Patent
Tener

(10) Patent No.: US 6,652,394 B1
(45) Date of Patent: Nov. 25, 2003

(54) PORTABLE MULTIFUNCTION BATTING TRAINER

(76) Inventor: David M. Tener, 12th Fl. Seven Penn Center 1635 Market St., Philadelphia, PA (US) 19103-2212

( * ) Notice: Subject to any disclaimer, the term of this patent is extended or adjusted under 35 U.S.C. 154(b) by 0 days.

(21) Appl. No.: 10/093,053

(22) Filed: Mar. 7, 2002

(51) Int. Cl.[7] ..... A63B 69/00; A63B 69/38; A63B 71/00

(52) U.S. Cl. ..... 473/417; 473/457; 473/464

(58) Field of Search ..... 473/417, 418, 473/420, 422, 133, 386, 387, 398, 457; 273/317, 317.6, 317.2, 371, 407; 214/16; 206/315.1, 579

(56) References Cited

U.S. PATENT DOCUMENTS

| | | | | |
|---|---|---|---|---|
| 704,128 A | | 7/1902 | Seymour | |
| 968,270 A | | 8/1910 | Schumacher | |
| 2,705,968 A | | 4/1955 | Mazzeo | |
| 3,521,883 A | | 7/1970 | Hamilton | |
| 3,830,362 A | * | 8/1974 | Tassone et al. | 473/457 |
| 3,863,920 A | * | 2/1975 | Tassone et al. | 473/398 |
| 3,933,241 A | * | 1/1976 | Tassone et al. | 206/315.1 |
| 3,955,816 A | | 5/1976 | Bratt | |
| 4,040,229 A | * | 8/1977 | Candor et al. | 473/418 |
| 4,227,691 A | | 10/1980 | Lefebvre et al. | |
| 4,646,398 A | | 3/1987 | Myhrman | |
| 4,881,736 A | * | 11/1989 | Fox | 473/417 |
| 5,069,237 A | | 12/1991 | Flanagan | |
| 5,149,092 A | | 9/1992 | Parsons | |
| 5,295,933 A | | 3/1994 | Ciminski et al. | |
| 6,009,995 A | | 1/2000 | Speck | |

* cited by examiner

*Primary Examiner*—Paul T. Sewell
*Assistant Examiner*—Mitra Aryanpour
(74) *Attorney, Agent, or Firm*—Caesar, Rivise, Bernstein, Cohen & Pokotilow, Ltd.

(57) ABSTRACT

A multifunction training device for batted ball sports, wherein said device is adapted to selectively convert from a bat configuration to a batting tee configuration. The device in its bat configuration is suitable for storing in a bat bag, and is preferably suitable for swinging as a bat.

20 Claims, 2 Drawing Sheets

PORTABLE MULTIFUNCTION BATTING TRAINER

BACKGROUND OF THE INVENTION

1. Field of Invention

The invention relates to batting training devices, and more particularly to batting tees and weighted bats.

2. Description of Related Art

It has been said that one of the most difficult feats in all of sports is hitting a pitched ball with a bat. While this statement was made in appreciation of the difficulty faced by professional baseball batters facing professional baseball pitchers, effectively hitting a pitched ball is still a significant challenge at lesser levels of competition.

One challenge faced by both professional and amateur ballplayers is the need to perform offensively several times a game with no continuity between such performances. After each at bat, a batter must wait for at least eight other batters to bat before he or she gets another opportunity to bat. Thus, a batter has a much more difficult time developing an effective rhythm, unlike a basketball player who can redeem a missed shot at with a field goal in mere seconds.

Batters have developed several techniques for dealing with this lack of offensive continuity inherent in the game. A batter is said to be "on-deck" when next in the order scheduled to bat. Batters who are on-deck typically swing a bat, which may or may not be weighted more heavily than a game bat, so as to warm-up their muscles for their impending at-bat. Weighted bats are disclosed, e.g., in U.S. Pat. No. 3,955,816 to Bratt, and devices for weighting bats, such as weighted rings, are disclosed, e.g., in U.S. Pat. No. 3,521,883 to Hamilton. Unfortunately, simply warming up the muscles does nothing for the batter's hand-eye coordination.

Training exercises that warm-up both the muscles and the batter's hand-eye coordination involve swinging at a target. The target can be moving or stationary. Batting practice, where a batter has a chance to hit a series of pitches in continuity is ideal before a game, but impractical during a game except in professional facilities having batting cages immediately adjacent to the baseball diamond.

Hitting a ball off of a tee is an exercise more readily available to the amateur ballplayer, but tees are not generally provided as a permanent part of a ball field. Batting tees are typically portable and usually comprise an upright post attached to a supporting base shaped like home plate. See, e.g., U.S. Pat. No. 4,227,691 to Lefebvre et al. While such tees are portable, they are not designed to fit the needs of the amateur ballplayer, as such tees are not configured to easily fit within equipment bags designed for baseball and softball (such as disclosed in, e.g., U.S. Pat. No. 6,009,995 to Speck), which are sometimes denoted as "bat bags".

Accordingly, it is desired to provide a portable batting tee configured to fit within a bat bag.

It is further desired to provide a portable batting tee capable of adopting a configuration resembling a game bat.

It is still further desired to provide a training device for batted ball sports, which can adopt a weighted bat configuration and a portable batting tee configuration.

All references cited herein are incorporated herein by reference in their entireties.

BRIEF SUMMARY OF THE INVENTION

Accordingly, the invention provides a multifunction training device for batted ball sports, wherein said device is adapted to selectively convert from a bat configuration to a batting tee configuration. The device in its bat configuration is suitable for storing in a bat bag, and is preferably suitable for swinging as a bat.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention addresses many of the deficiencies of the prior art in providing a batted ball sport training device adapted to reversibly convert from a batting tee configuration to a storable configuration to fit within a bat bag.

As bat bags are by definition designed to carry bats therein, the training device of the invention in its storable configuration has a size and shape approximating those of a bat. Thus, the training device when in said storable (or bat) configuration preferably has a maximum transverse diameter of less than 6 inches (15 cm), and a maximum length of less than 40 inches (102 cm).

The stability of the training device in its batting tee configuration is affected by the width of its base relative to its height. Accordingly, the training device in its batting tee configuration should have a maximum transverse diameter suitable for maintaining the device upright while a ball is being hit off of the device. The maximum transverse diameter in the batting tee configuration is preferably at least 12 inches (30 cm). In certain embodiments, the maximum transverse diameter in the batting tee configuration is at least three times larger than the maximum transverse diameter of the training device when in its storable (or bat) configuration.

Figure 1A:
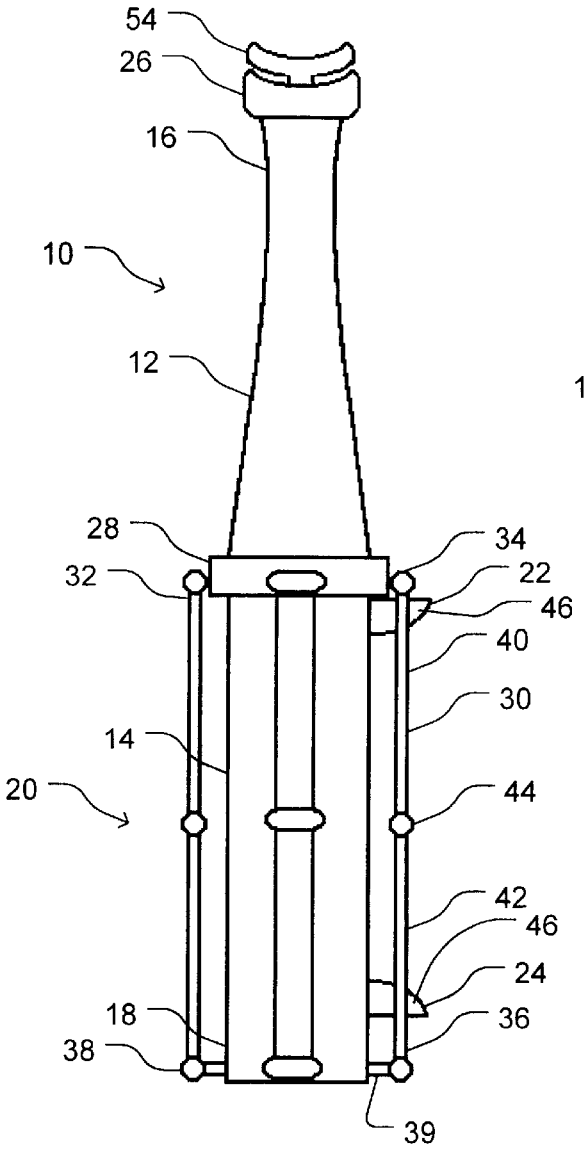
FIG. 1A is a side view of an embodiment of a training device of the invention in its storable/bat configuration.
Figure 1B:
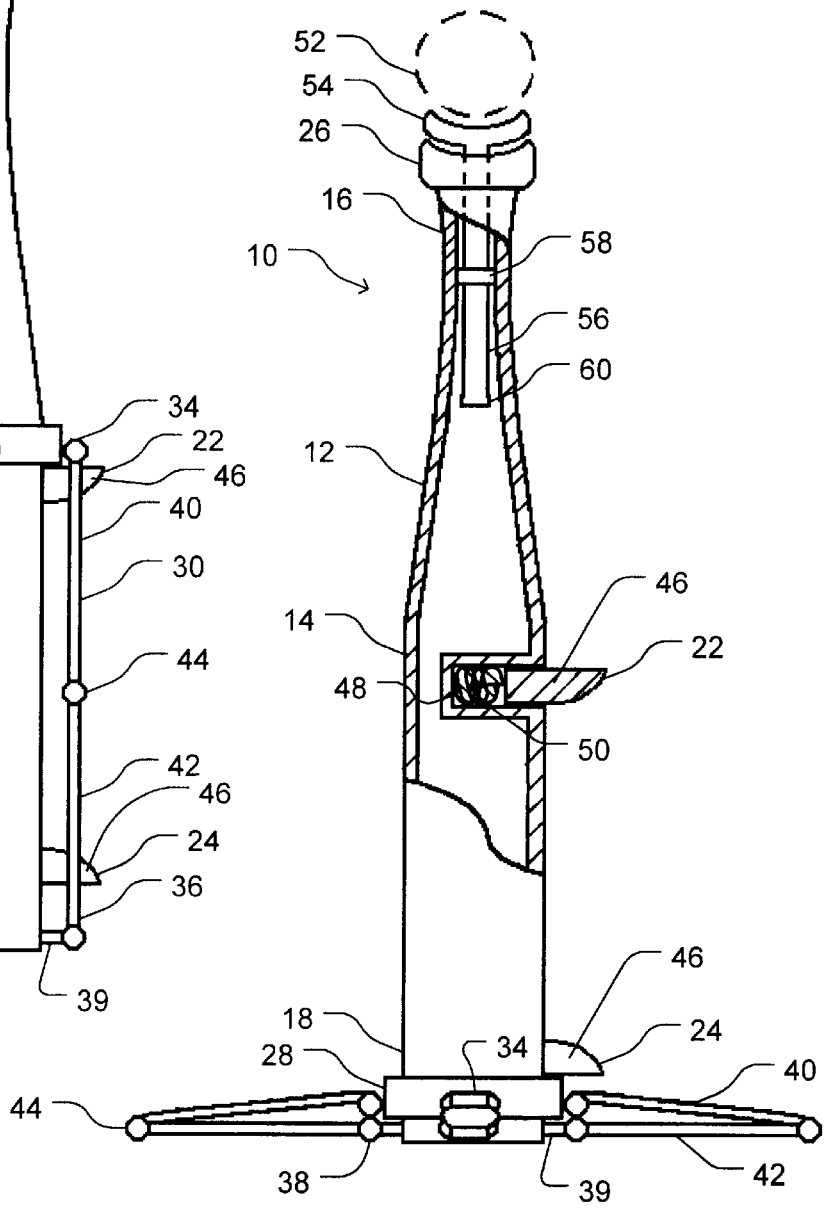
FIG. 1B is a partial cross-section view of the embodiment of FIG. 1A in its batting tee configuration.

Referring to FIGS. 1A and 1B, training device 10 includes: shaft 12 having medial portion 14 between proximal end 16 and distal end 18; expandable base 20 mounted on shaft 12 and adapted to slidably reciprocate between the bat configuration shown in FIG. 1A and the batting tee configuration shown in FIG. 1B; proximal locking device 22 on shaft 12 to reversibly fix expandable base 20 in the bat configuration; and distal locking device 24 on shaft 12 to reversibly fix expandable base 20 in the batting tee configuration.

Preferably, the bat configuration is suitable for swinging like a bat. Such preferred embodiments further comprise knob 26 at a terminus of proximal end 16.

In the embodiment depicted in FIGS. 1A and 1B, expandable base 20 comprises ring 28 slidably engaged about shaft 12, and at least one folding leg 30 having proximal leg end 32 attached to ring 28 via proximal hinge 34, and distal leg end 36 attached to distal end 18 of shaft 12 via distal hinge 38 and post 39. FIGS. 1A and 1B show an embodiment of the invention wherein each folding leg 30 is constructed of proximal segment 40 and distal segment 42 joined by medial hinge 44. Expandable base preferably comprises at least three folding legs 30. When folded, folding legs 30 balance shaft 12 in an upright position perpendicular to the playing surface on which training device 10 is deployed.

In certain embodiments, the folding legs when extended function as air brakes, which provide resistance to swinging the device through the air. Alternatively (or additionally), training device 10 can be weighted to provide additional resistance to the batter. The weight of training device 10 and the ideal weight distribution of training device 10 can be determined through routine experimentation using the disclosure herein as a guide.

Ring 28 can be the source of a disproportionate amount of the overall weight of training device 10, as in the case of a removable batting ring or donut and a conventional bat. An additional advantage of providing a ring 28 that is weighted is that the additional weight is shifted to distal end 18 of shaft 12 when training device 10 is in its batting tee configuration. Bottom weighting enhances the stability of training device 10 in this configuration. Preferably, the size, shape and materials of training device 10 and its components are selected so as to provide the device in its bat configuration with a weight balance approximating that of a conventional game bat or weighted training bat, and to provide the device in its batting tee configuration with a maximum amount of weight concentrated at distal end 18. The movement of the ring, legs and hinges facilitates achieving this goal, as their weight shifts toward the distal end of the shaft when the device is converted from the bat configuration to the batting tee configuration.

In embodiments of the invention wherein training device 10 interconverts between a batting tee configuration and a bat configuration suitable for swinging as a bat, it is particularly important from a safety standpoint to ensure that the training device does not inadvertently convert from one configuration to the other. This is a role of the proximal locking device 22 and distal locking device 24. Any locking device suitable for releasably locking a sliding part in a desired position is suitable for use as proximal locking device 22 and distal locking device 24. Such devices are employed in a variety of contexts, including in umbrellas (U.S. Pat. No. 704,128 to Seymour, U.S. Pat. No. 968,270 to Schumacher, U.S. Pat. No. 2,705,968 to Mazzeo, and U.S. Pat. No. 5,069,237 to Flanagan), extendable batons (U.S. Pat. No. 5,149,092 to Parsons), barbell collars (U.S. Pat. No. 5,295,933 to Ciminski et al.), etc. (U.S. Pat. No. 4,646,398 to Myhrman).

FIGS. 1A and 1B show an embodiment of the invention wherein proximal locking device 22 and distal locking device 24 each comprise latch 46 mounted above spring 48 within well 50. Spring 48 biases latch 46 against movement into well 50. Each latch 46 preferably has a sloped profile on the side of the latch facing the other latch and a flat profile on its opposite side, such that movement of ring 28 over proximal locking device 22 is easiest in a proximal direction and movement of ring 28 over distal locking device 24 is easiest in a distal direction. The sloped surface and position of latch 46 within well 50 enables ring 28 to force latch 46 into well 50 when slid along the sloped surface. The flat surface of latch 46 resists passage of ring 28 until latch 46 is manually depressed into well 50 in the process of converting the conformation of training device 10.

It should be understood that latch 46 can have a shape other than that shown in the FIGS. 1A and 1B, and need not be sloped or perfectly perpendicular to shaft 12.

It should also be understood that proximal locking device 22 and distal locking device 24 are not limited to the mechanisms shown in the Figures, but rather can comprise other mechanisms adapted to achieve the same goals. For example, ring 28 can be releasably locked in place by magnetic force, friction, hook and eye fasteners (e.g., Velcro), reciprocating cams (see, e.g., Myhrman, supra), torsion spring collars .(e.g., as used for barbell collars) and/or complementary threading on shaft 12 and inside of ring 28.

Training device 10 is converted from the bat configuration of FIG. 1A to the batting tee configuration of FIG. 1B by releasing proximal locking device 22 and sliding ring 28 distally down shaft 12 until ring 28 is engaged by distal locking device 24. Training device 10 is then placed on the ground or playing surface distal end down. Ball 52 can then be placed into ball cup 54 at the proximal end of the training device.

In the preferred embodiment shown in FIG. 1B, ball cup 54 is mounted on the proximal end of extension rod 56, which extends down inside shaft 12 and through retainer 58. The distal end of extension rod 56 has a catch 60, which prevents the entire length of extension rod 56 from passing through retainer 58. In the embodiment depicted in FIG. 1B, catch 60 has an external diameter wider than the internal diameter of retainer 58. Extension rod 56 enables ball 52 to be held in spaced apart relation from shaft 12 at a selectable height above a playing surface. Extension rod 56 and retainer 58 cooperate to releasably fix ball cup 54 and ball 52 at a plurality of heights above shaft 12 to accommodate ballplayers of various heights and various hitting preferences. This can be accomplished through a friction-feed mechanism, a ratcheting mechanism (with catch 60 acting to release the ratcheting action so that extension rod 56 can be reinserted into shaft 12), a screw-lock mechanism (e.g., as on microphone stands and extension rods for painting) or any other means for feeding desired increments of a first coaxial member from a second coaxial member.

Ball 52 can be a ball suitable for game use, or can be provided as a part of training device 10. Ball 52 can be permanently or removably fixed to ball cup 54.

Ball 52, ball cup 54 and extension rod 56 are preferably fabricated from materials) having a hardness sufficiently low so as to avoid damaging a bat hitting them, and having a resiliency sufficiently high so as to avoid being damaged by a bat. They need not be fabricated from the same material(s) Suitable materials include, but are not limited to, metals, plastics and woods.

It is particularly preferred that a least a portion of extension rod 56 is flexible, such that it can absorb at least some of the energy of being struck with a bat, thereby enhancing the stability of expandable base 20 and minimizing negative feedback to the batter. In certain embodiments, extension rod 56 can comprise a coiled steel spring and/or polyamides, such as nylon.

FIGS. 1A and 1B depict an embodiment of the invention wherein each folding leg 30 is constructed of proximal segment 40 and distal segment 42 joined by medial hinge 44. It is also within the scope of the invention to provide at least one unitary folding leg attached to distal end 18 of shaft 12 via distal hinge 38 and post 39, such that the entire leg pivots about 90° about distal hinge 38 from its position parallel to the longitudinal axis of the shaft in the bat configuration, to its position perpendicular (or substantially perpendicular) to the longitudinal axis of the shaft in the batting tee configuration.

The invention further encompasses multifunction batting trainers wherein the expandable base comprises an inflatable fabric in fluid communication with a source of a fluid, such that the base can be inflated to stabilize the apparatus for use as a batting tee. It is preferred that the fluid be a gas, preferably ambient air, which is pumped into the inflatable fabric by a manual or electrical pump built in to the batting trainer. Extension rod 56, which extends down inside shaft 12 and through retainer 58, can be attached to a piston within the bat barrel to pump air into the inflatable fabric. The air or other fluid preferably passes through a valve adapted to selectively seal the fluid in the inflatable fabric when the trainer is in the batting tee configuration, and to release the fluid when desired by the user. The inflatable fabric is a durable, flexible and air-tight material, such as might be used in the inner tubes of tires (e.g., natural or synthetic rubber) or air bags for automobiles (e.g., polymer coated fabrics, polyamide fabrics, etc.).

Figure 2:
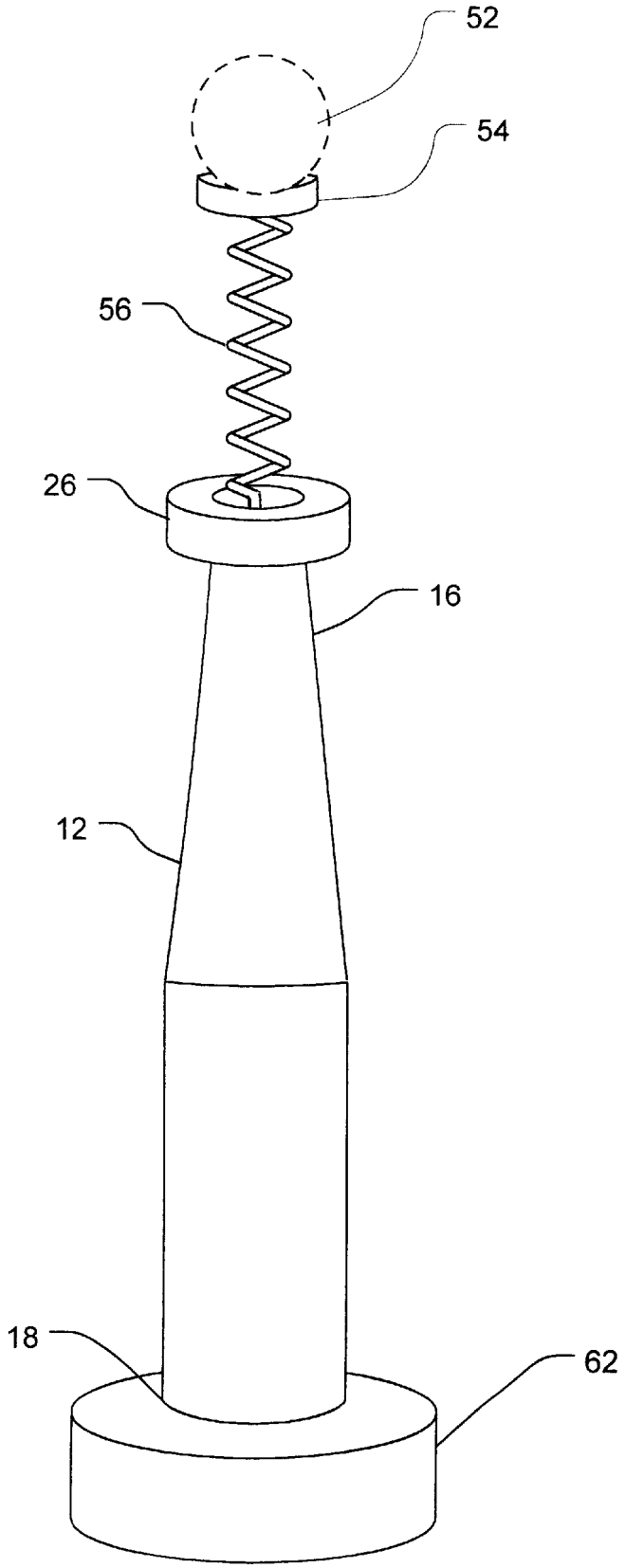
FIG. 2 is a side view of another embodiment of a training device of the invention in its batting tee configuration.

The invention still further encompasses multifunction batting trainers that do not include an expandable base, but rather include a base of fixed dimensions 62, as shown in FIG. 2. Such training devices are significantly tapered from distal end 18 to proximal end 16 and preferably bottom (distal) weighted, e.g., in a manner similar to floor-mounted punching bags of the self-righting type. Preferably, the base of such embodiments has a plate-like shape as shown in FIG. 2. Ball cup 54 is mounted on extension rod 56, which reciprocates proximally and distally such that ball 52 can be held in spaced apart relation from shaft 12 at a selectable height above a playing surface. Extension rod 56 in the embodiment of FIG. 2 is a spring, but could be provided in the form of other flexible, durable materials adapted to absorb much of the energy of being hit with a bat, without transmitting a destabilizing amount of the energy to shaft 12.

While the invention has been described in detail and with reference to specific examples thereof, it will be apparent to one skilled in the art that various changes and modifications can be made therein without departing from the spirit and scope thereof.

What is claimed is:

1. A multifunction training device for batted ball sports, comprising:

a shaft; and an expandable base mounted on said shaft, wherein said expandable base is adapted to contract to adopt a bat configuration and expand to adopt a batting tee configuration, wherein said training device is adapted to selectively convert from the bat configuration to the batting tee configuration and wherein each of the bat configuration as used for swinging and the batting tee configuration includes the shaft and the expandable base.

2. The training device of claim 1, wherein said training device when in said bat configuration has a maximum transverse diameter of less than 6 inches (15 cm).

3. The training device of claim 1, wherein said training device when in said batting tee configuration has a maximum transverse diameter of at least 12 inches (30 cm).

4. The training device of claim 1, wherein said training device has a maximum transverse diameter in said batting tee configuration at least three times larger than the maximum transverse diameter of said training device when in said bat configuration.

5. The training device of claim 1, wherein the shaft has a medial portion between a proximal end and a distal end, the expandable base is adapted to slidably reciprocate between said bat configuration and said batting tee configuration, and the training device further comprises:

proximal locking device on said shaft to reversibly fix said expandable base in said bat configuration; and a distal locking device on said shaft to reversibly fix said expandable base in said batting tee configuration.

6. The training device of claim 5, wherein said shaft comprises a knob at a terminus of said proximal end thereof.

7. The training device of claim 1, wherein the shaft has a medial portion between a proximal end and a distal end, the expandable base is adapted to selectively inflate from said bat configuration to said batting tee configuration, and the training device further comprises a fluid source for inflating said expandable base with a fluid.

8. A multifunction training device for batted ball sports, comprising:

a shaft having a medial portion between a proximal end and a distal end;

an expandable base mounted on said shaft and adapted to slidably reciprocate between a bat configuration and a batting tee configuration, wherein said expandable base comprises a ring slidably engaged about said shaft, and at least one folding leg having a proximal leg end attached to said ring and a distal leg end attached to said distal end of said shaft;

a proximal locking device on said shaft to reversibly fix said expandable base in said bat configuration; and a distal locking device on said shaft to reversibly fix said expandable base in said batting tee configuration.

9. The training device of claim 7, wherein said expandable base comprises at least three folding legs, and said folding legs when folded balance said shaft in an upright position perpendicular to a playing surface.

10. The training device of claim 8, wherein said folding legs when extended function as air brakes providing resistance to swinging the device through the air.

11. The training device of claim 7, wherein said proximal locking device and said distal locking device each comprise a biased latch adapted to engage said ring and prevent said ring from sliding along said shaft.

12. The training device of claim 7, wherein said proximal locking device and said distal locking device each comprise threading on said shaft adapted to engage complementary threading within said ring and prevent said ring from sliding along said shaft.

13. The training device of claim 7, further comprising a ball cup reciprocally mounted at a proximal end of said training device, such that a ball can be held in spaced apart relation from said shaft at a selectable height above a playing surface.

14. The training device of claim 12, wherein said ball is removably fixed to said ball cup by a fastener, said fastener being adapted to prevent releasing said ball when hit with a bat.

15. The training device of claim 14, wherein the fluid source is a pump and the fluid is air.

16. The training device of claim 7, wherein each of the bat configuration as used for swinging and the batting tee configuration includes the shaft and the expandable base.

17. The training device of claim 8, wherein each of the bat configuration as used for swinging and the batting tee configuration includes the shaft and the expandable base.

18. The training device of claim 11, wherein each of the bat configuration as used for swinging and the batting tee configuration includes the shaft and the expandable base.

19. The training device of claim 12, wherein each of the bat configuration as used for swinging and the batting tee configuration includes the shaft and the expandable base.

20. The training device of claim 19, wherein said expandable base comprises at least three folding legs, and said folding legs when folded balance said shaft in an upright position perpendicular to a playing surface.

* * * * *